United States Patent [19]

Clements

[11] Patent Number: 4,848,484

[45] Date of Patent: Jul. 18, 1989

[54] SOIL SAMPLE EXTRACTION TOOL

[76] Inventor: James M. Clements, R.R. 1, Box 186, Newton, Iowa 50208

[21] Appl. No.: 202,404

[22] Filed: Jun. 6, 1988

[51] Int. Cl.[4] ..... E21B 25/14; G01N 1/08; A01B 45/02; A01C 5/02

[52] U.S. Cl. ..... 175/20; 175/254; 73/864.44; 111/92; 172/22; 294/50.9

[58] Field of Search ..... 175/19, 20, 58, 161, 175/308, 253, 254; 294/50.5–50.9; 73/864.42, 864.43, 864.44, 864.45, 864.64; 111/89, 92; 171/56; 172/21, 22; 30/130

[56] References Cited

U.S. PATENT DOCUMENTS

| | | | |
|---|---|---|---|
| D. 269,844 | 7/1983 | Hackerson | D8/7 |
| 682,623 | 9/1901 | Hughes et al. | 294/50.5 |
| 816,236 | 3/1906 | Kline | 175/403 |
| 1,586,415 | 5/1926 | Duda | 175/245 |
| 1,860,963 | 5/1932 | Smith | 294/50.5 |
| 2,014,311 | 9/1935 | Council | 294/50.5 |
| 2,686,073 | 8/1954 | Benoist | 294/50.9 |
| 3,352,160 | 11/1967 | Mount | 175/253 |
| 3,375,891 | 4/1968 | Murati | 175/403 |
| 3,786,877 | 1/1974 | Schafer et al. | 175/249 |
| 4,098,360 | 7/1978 | Clements | 175/313 |
| 4,106,576 | 8/1978 | Clements | 175/313 |
| 4,117,896 | 10/1978 | Weber | 175/84 |
| 4,556,114 | 12/1985 | Ryan | 175/20 |
| 4,790,392 | 12/1988 | Clements | 175/20 |

FOREIGN PATENT DOCUMENTS 617702 4/1976 U.S.S.R. .

OTHER PUBLICATIONS

JMC Soil Investigation Equipment catalog No. 7, p. 14.

*Primary Examiner*—Bruce M. Kisliuk
*Attorney, Agent, or Firm*—Zarley, McKee, Thomte, Voorhees & Sease

[57] ABSTRACT

A soil sample extraction tool including a container having a soil sample receiving chamber, the chamber being accessible by an opening in the container. A first end of the container is engageable with the soil and allows passage of the soil sample to the chamber. A closure member or door is adjustably movable with respect to the opening in the container. A control member is operatively connected to the closure member and allows movement of the closure member with respect to the opening in the container to facilitate opening of the closure member to gain access to the sample receiving chamber.

18 Claims, 3 Drawing Sheets

SOIL SAMPLE EXTRACTION TOOL

BACKGROUND OF THE INVENTION a. Field of the Invention

This invention relates to soil sample extraction tools, and in particular, to soil sample extraction tools which allow easy access to the soil sample after it is extracted from the soil.

b. Problems in the Art

Many soil sampling devices have been developed and are in use. Their uses are varied and their objectives differ for those uses. For example, some soil sample devices are used simply to extract a quantity of soil from a given location or depth. Others are aimed at obtaining and preserving a representative sample of layers of soil so it can be studied in an undisturbed state.

Significant problems exist in obtaining undisturbed core samples. Most tools involve forcibly inserting a tool into the soil to a desired depth or soil sample position. A container in the soil sample tool then captures the desired soil sample core, and then the tool allows extraction of that sample from the ground.

Problems exist in, first, designing the tool so that the targeted soil sample is not altered by the means used by the tool to reach the soil sample. Some tools have cutting or boring heads which disturb or otherwise alter the targeted soil sample. Secondly, many tools have the problem of compacting or squeezing the soil as the sample is being obtained. Third, many present tools allow, or do not prevent, leaching or contamination of the sample by surrounding soil, either as the tool is being inserted, as the sample is being taken, or as the tool is being extracted. An additional problem is that many tools are configured so as to make it difficult to remove the soil sample from the tool for study while keeping the sample intact.

A common soil sample tool comprises a tubular container having a cutting tip. The container is inserted into the ground and the soil sample fills up the container. The tool is then removed from the soil. Because access to the soil sample chamber in the tools is many times through the cutting opening only, it is difficult to remove the soil sample which is basically compactionally held therein.

Other tools have therefore utilized a tubular container having an open, uncovered access along its side. The cutting tip still causes a cylindrical core sample to be taken into the container, but once extracted from the soil, the sample can basically be lifted out of the container, or analyzed as it is held therein. A significant difficulty is that surrounding soil can invade into the sample chamber through the opening, and that exposed part of the sample can be eroded, leached or scraped away, diminishing the value of the sample or the ability to accurately analyze it.

Some attempts have been made to retain the benefit of having a completely closed container, but still allowing access through the side of the container to the sample. Many of these attempts have been unreliable, in that they allow leaching or alteration of the sample during its taking, or are difficult to use. Others are complex to the point where they are uneconomical or inefficient for use as soil sampling devices.

These problems are particularly evident in situations where the sampling tool must be rotated or pivoted as it moves through the soil. Examples of such tools are called soil sampling augers. As is evident, rotation through the soil requires sampling tools which have minimal resistance to rotation, and which do not have outward protrusions so that the tool can easily cut through the soil. Also, there must be minimal resistance or protrusion of any part of the tool in the sample receiving chamber so that the soil sample can smoothly and easily pass into the chamber.

Many present attempts at developing soil sampling tools which allow easy access to the soil sample after extraction are insufficient or deficient in these respects. It is therefore a principal object of the present invention to provide a soil sample extraction tool which solves or improves over the problems and deficiencies in the art.

Another object of the present invention is to provide a tool as above described which allows the obtaining and extraction of accurate soil samples, and easy access to those samples.

A further object of the present invention is to provide a tool as above described, which causes minimal disruption of the sample.

A further object of the present invention is to provide a tool as above described which can obtain a reliable sample from a number of different soil types and conditions.

Another object of the present invention is to provide a tool as above described which is non-complex, easy to use, and easy to maintain.

A further object of the present invention is to provide a tool as above described which allows easy access to an extracted soil sample, but does not cause unnecessary disruption of the soil or the soil sample by a structure.

Another object of the present invention is to provide a tool as above described which is efficient, durable and economical.

These and other objects, features, and advantages of the invention will become more apparent with reference to the accompanying specification and claims.

SUMMARY OF THE INVENTION

The present invention is a soil sample extraction tool which allows reliable obtaining of a soil sample, easy extraction of the sample, and easy access to the sample after extraction. A soil sample container means includes a first end which is engagable with the soil and allows passage of the soil sample into a soil sample chamber.

A closure means is positionable over an opening in the container means so as to present a closed container when the sample is being obtained.

A control means is operatively connected to the closure means and allows an operator to move the closure means with respect to the opening in the container means to gain easy access to the soil sample once the sample is extracted and the tool is removed from the soil. Operation of the control means frees the closure means to be opened away from the opening in the container means. The soil sample can then either be inspected, analyzed and operated upon, or removed with minimal disruption to the sample.

In one embodiment, the closure means includes a lever which is connected by linkage means to the closure means. By moving the lever, the linkage means causes the closure means to slide away from a locked position on the container means. The closure means can then be pivoted to open and gain access to the soil sample.

The control means does not interfere with or disrupt the soil at any depth during the obtaining and extraction of the soil sample. Likewise, the closure means does not interfere with efficient and easy insertion and extraction of the tool from the ground, nor does it disrupt the ease of capturing or obtaining the soil sample into the chamber of the container means.

DETAILED DESCRIPTION OF THE PREFERRED EMBODIMENT

Figures 1, 2, 3:
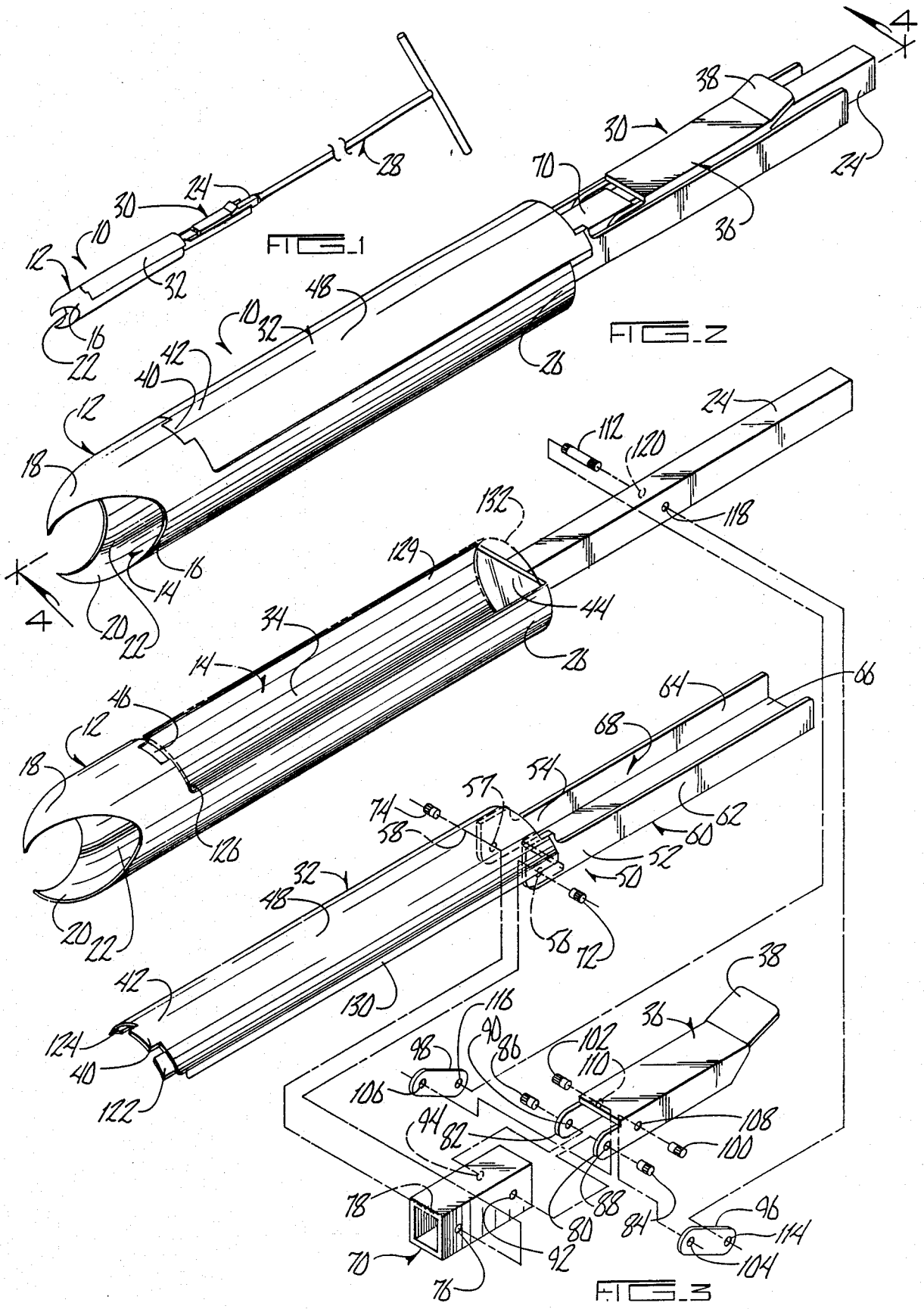
FIG. 1 is a reduced scale perspective view of one embodiment of the invention operatively connected to a handle means.
FIG. 2 is an enlarged perspective view of the invention of FIG. 1.
FIG. 3 is an exploded view of FIG. 2.

With reference to the drawings, a preferred embodiment of the present invention will be described. Like reference numerals will refer to like parts throughout the drawings.

FIG. 1 depicts a soil sample tool 10 in accordance with the present invention. In this embodiment, tool 10 comprises what is known in the art as a bucket auger. A container 12 has a hollow soil sample chamber 14. Leading end 16 of tool 10 comprises auger blades 18 and 20 which precede the aperture 22 for access into chamber 14.

A neck 24 extends from the trailing end 26 of container 12, and is removably connectable to a handle 28 by threadable connections or other means such as are known in the art. Handle 28 is T-shaped allowing gripping and rotation of tool 10 to facilitate auger-like boring of tool 10 into the soil.

A control apparatus 30 is associated with neck 24, and is operatively connected to closure 32 which covers an opening 34 (see FIG. 3) on the side of container 12. As will be described further below, control apparatus 30 allows an operator to unlock or release closure 32 from locked engagement with container 12, and further allows closure 32 to be opened away from container 12 so that a soil sample in container 12 can be easily studied, accessed and removed if desired.

It is to be understood that closure 32 conforms very closely to the shape of container 12 to present a basically smooth cylindrical outer surface, and a smooth cylindrical inner surface. Additionally, control apparatus 30 and neck 24 are of a smaller cross-sectional perimeter than the cross-sectional diameter and perimeter of the container 12 so that during insertion and extraction of tool 10 from the soil, control apparatus 30 and neck 24 do not disturb or contact the soil. Therefore, during insertion of tool 10 into the soil, obtaining of the soil sample, and extraction of the sample from the soil, tool 10 functions as if container 12 was a unitary cylindrical tubular body. Further, control apparatus 30 folds against neck 24 so that it assumes a basically rectangular cross-sectional configuration with minimal protrusions; as if it were part of neck 24.

FIGS. 2 and 3 show in more detail the exact structural features of the preferred embodiment. FIG. 2 depicts tool 10 in condition for insertion into the soil, obtaining of the soil sample, and extraction from the soil. Closure 32 is flush against container 12, and the control apparatus 30 is folded against neck 24. It can be seen that control lever 36 has a slightly outwardly inclined tip 38 which enables an operator to easily grasp, pivot and operate lever 36 towards and away from neck 24. It can also be seen that in the preferred embodiment, at least one tab 40 extends from the forward end 42 of closure 32 to facilitate locking of closure 32 to container 12.

FIG. 3 specifically shows that trailing end 26 of container 12 is substantially sealed off by end wall 44. Neck 24, being rectangular in cross-section, is rigidly attached to end wall 44 and extends outwardly therefrom generally along the longitudinal axis of container 12. The outer surface of container 12 includes a rectangular recess 46 for mating with tab 40 of closure 32. Auger blades 18 and 20 are conventional, as are known in the art, and serve to allow easy rotational boring into the soil, with minimal disruption of the soil.

Closure 32 is basically comprised of three sections. Cover section or door 48 is essentially a curved side wall of container 12 and matably serves to cover opening 34 in container 12. Hinge section 50 is comprised of a pair of parallel flanges 52 and 54, each having respective apertures 56 and 58 aligned along a pivot axis 58. Hinge section 50 is rigidly attached to the end of closure 32 opposite tab 40.

Extension section 60 consists of two parallel rails 62 and 64 extending from flanges 52 and 54, and being joined along laterally adjacent edges by a plate 66.

It can therefore be seen that if a plane were constructed through pivot axis 58 parallel to the longitudinal axis of cover section 48 and extension section 60 of closure 32, most, if not all, of cover section 48 would be on a side of the plane opposite from plate 66. An open area (designated generally by reference numeral 68) exists laterally between flanges 52 and 54 of hinge section 50, and between cover section 48 and extension section 60 of closure 32. Open area 68 allows the insertion of neck 24 between and through flanges 52 and 54 of hinge section 50 so that plate 66 of extension section 60 is positioned underneath neck 24, in the orientation shown in FIGS. 2 and 3, and cover section 48 is positioned above and over opening 34 in container 12, in the orientation of the tool shown in FIGS. 2 and 3.

In the preferred embodiment, a carriage 70 is slidably positionable along neck 24. Hinge section 50 is pivotally secured to carriage 70 by the insertion of pivot pins 72 and 74 through apertures 56 and 57 in flanges 52 and 54 and through apertures 76 and 78 of carriage 70.

The end of carriage 70 opposite apertures 76 and 78 receives control lever 36 in a pivotal relationship. Control lever 36 includes spaced apart parallel flanges 80 and 82 which overlap one end of carriage 70. Pivot pins 84 and 86 extend through corresponding apertures 88 and 90 in flanges 80 and 82, and 92 and 94 in carriage 70.

First ends of linkage arms 96 and 98 are pivotally attached to opposite sides of control lever 36 by pivot pins 100 and 102 (through corresponding apertures 104, 106 of linkage arms 96 and 98, and apertures 108 and 110 of control lever 36). Opposite second ends of linkage arms 96 and 98 are pivotally attached to neck 24 by virtue of a single pivot pin 112 through apertures 114, 116 of linkage arms 96 and 98, and apertures 118 and 120 of neck 24.

FIG. 2 depicts tool 10 in assembled, closed, and locked form. It can be seen that all pivot pins and apertures are enclosed within hinge section 50 or extension section 60 of closure 32. In closed form, control apparatus 30 closely conforms to and simulates neck 24 of tool 10. There are minimal exposed portions, none of which exceed the outside diameter of container 12.

It is further pointed out that forward end 42 of closure 32 can contain a plurality of tabs. In the preferred embodiment, tab 40 serves as a positioning guide for cover section 48 of closure 32 when it is slid into a locked position. Tabs 122 and 124 (see FIGS. 3, 4, and 5) extend underneath the edge 126 of container 12 into respective recesses (see FIG. 10) and therefore serve to lock cover section 48 from movement outwardly of opening 34 of container 12 when in such a position as shown in FIG. 2. The sliding of cover section 48 with respect to opening 34 is facilitated by flat edges 128 and 129 around opening 34, and by flange rails 130 and 131 along the longitudinal edges of cover section 48.

Figure 4:
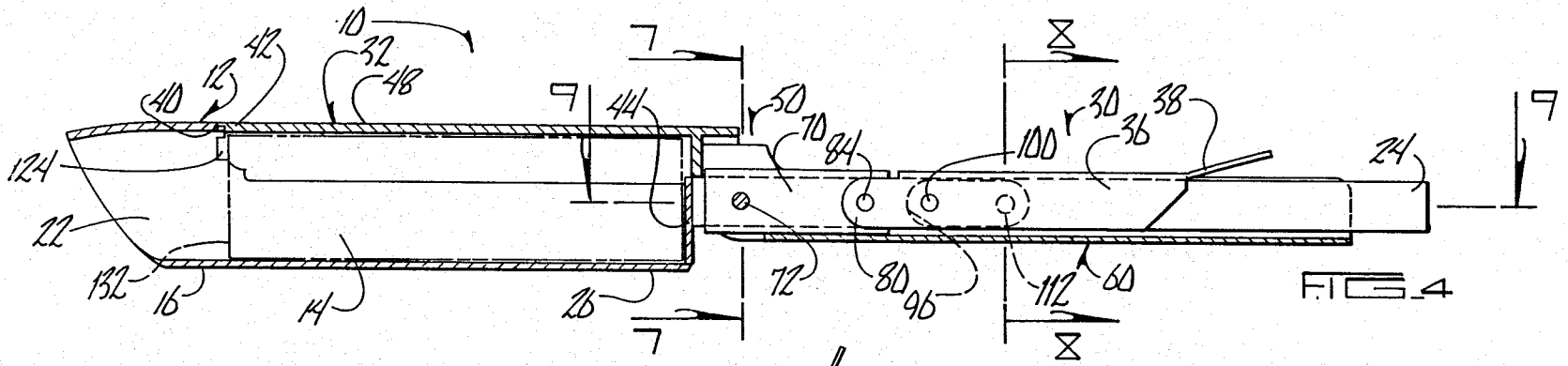
FIG. 4 is a cross-sectional elevational view taken along lines 4—4 of FIG. 2, showing the closure means in a locked position on the container means.
Figure 5:
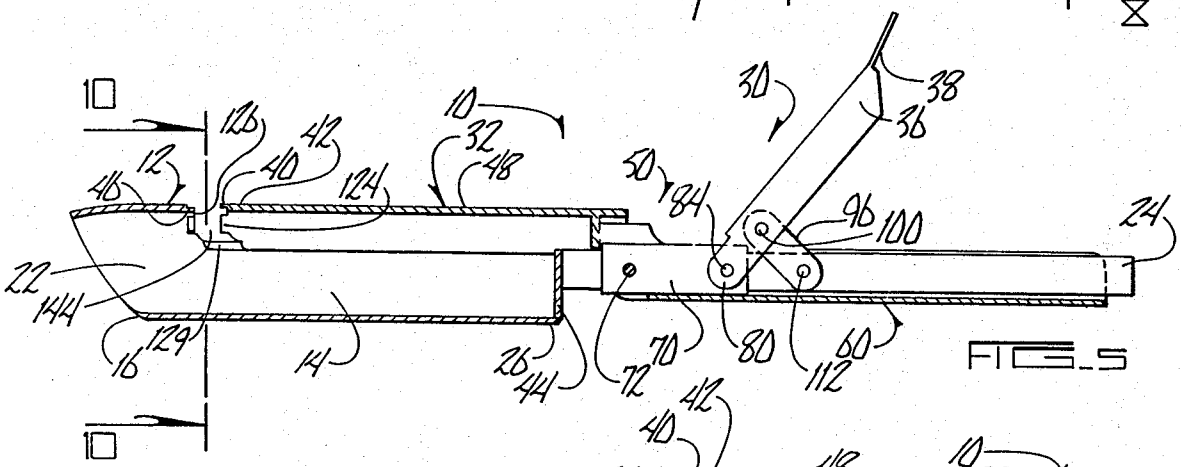
FIG. 5 is a cross-sectional elevational view similar to FIG. 4 except reduced in size and showing the closure means unlocked from the container means, but still in a generally covering position on the container means.
Figure 6:
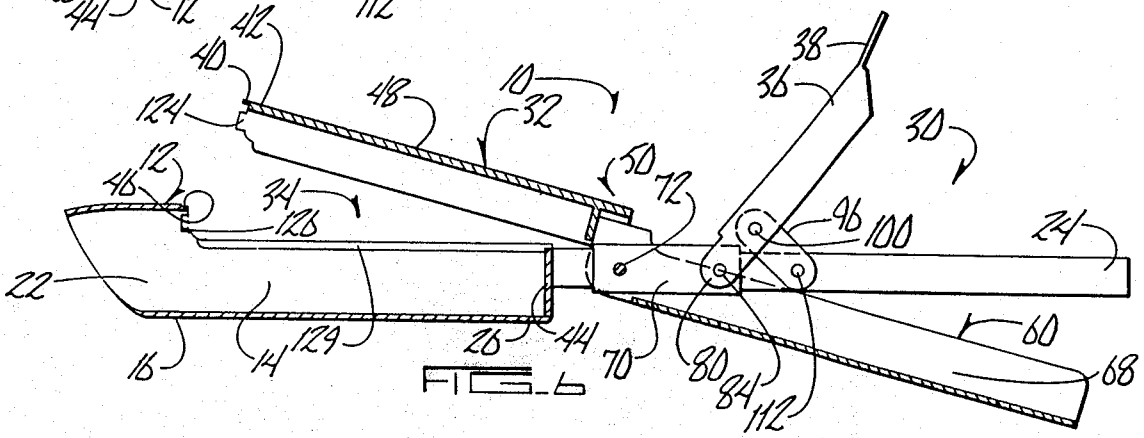
FIG. 6 is a cross-sectional elevational view similar to FIG. 4, except showing the closure means unlocked and opened away from the container means.

The specific operation of control apparatus 30 with respect to closure 32 is set forth in more detail in FIGS. 4–6. FIG. 4 depicts the locked position, as shown in FIG. 2. Cover section 48 of closure 32 is conformingly and matingly covered over opening 34 of container 12. Tabs 40, 122 (not shown), and 124 are engaged in their mating recesses. Additionally, extension section 60 is closely adjacent and basically parallel to neck 24, with control lever 36 also being basically laid flat against neck 24. It can be seen that linkage arm 96 and linkage arm 98 (not shown) extend longitudinally generally parallel to the longitudinal axis of neck 24. Because linkage arms 96 and 98 are pivoted at one end to neck 24, and the other end to control lever 36, pivoting, of control lever 36 down flat against neck 24 causes linkage arms 96 and 98 to slide carriage 70 towards trailing end 26 of container 12. Because closure 32 is pivotally connected to carriage 70, this causes closure 32 to be moved towards leading end 16 of container 12. If closure 32 is pivoted to the position shown in FIG. 4, it allows closure 32 to be slid along opening 34 so that tabs 40, 122 and 124 engage and lock cover section 48 in place. In the position of FIG. 4, forces from inside chamber 14 cannot move cover section 48 away from opening 34; and conversely, forces from outside container 12 cannot push cover section 48 inwardly. Because control lever 36 is basically also locked against neck 24, forces can also not cause cover section 48 to slide along opening 34. Finally, locked closure 32 cannot be removed from its locked state by rotational forces against container 12 or control lever 36. Because container 12 is wider in diameter than control apparatus 30, control lever 36 will not engage or be disturbed by the soil during the soil sample procedure. Rails 62 and 64 of extension section 60 will protect the pivot apparatus of the control apparatus 30 from the soil or other disturbances.

When access to chamber 14 of container 12 is desired, FIG. 5 shows the first step for doing so. Tip 38 of control lever 36 is grasped and pulled away from neck 24. This movement causes linkage arms 96 and 98 to angle upwardly and causes the pivotal attachment of control lever 36 to carriage 70 to draw carriage 70 away from trailing edge 26 of container 12. This also slidably draws cover section 48 of closure 32 a distance along opening 34 of container 12 to release tabs 40, 122, and 124 from locking engagement with edge 126 of container 12. Cover section 48 still substantially covers or closes off opening 34 (except for a small gap 144), but releases closure 32 from its locked position.

FIG. 6 then shows that closure 32, being released from a locked position, can be pivoted by grasping extension section 60, and moving it away from neck 24. This in turn causes cover section 48 to move away from opening 34 of container 12 to allow access to chamber 14. Cover section 48 itself can be grabbed and moved away from container 12.

It therefore can be seen that closure 32 can move between basically three positions; a covered and locked position shown in FIG. 4, an unlocked but generally covered position shown in FIG. 5, and an open position shown in FIG. 6. It is to be understood that closure 32 can be designed so as to pivot far enough away from container 12 so that complete access to chamber 14 is possible. Although not shown, cover section 48, in the preferred embodiment, can be rotated or pivoted to 90° or more away from container 12. This would allow a complete soil sample to be lifted out of chamber 14. In some instances, a plastic tubular sleeve 132 (shown in ghost lines in FIG. 4) can be utilized to receive the soil sample in the chamber 14. The entire sleeve 132 (having at least its forward end open), containing the soil sample, could then be removed intact from tool 10, after opening closure 32.

Figure 7:
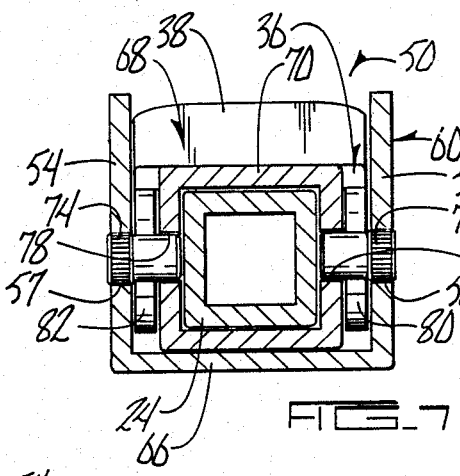
FIG. 7 is a sectional view taken along line 7—7 of FIG. 4.
Figure 8:
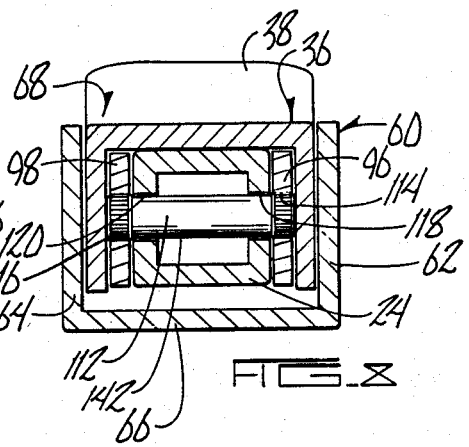
FIG. 8 is a sectional view taken along lines 8—8 of FIG. 4.
Figure 9:
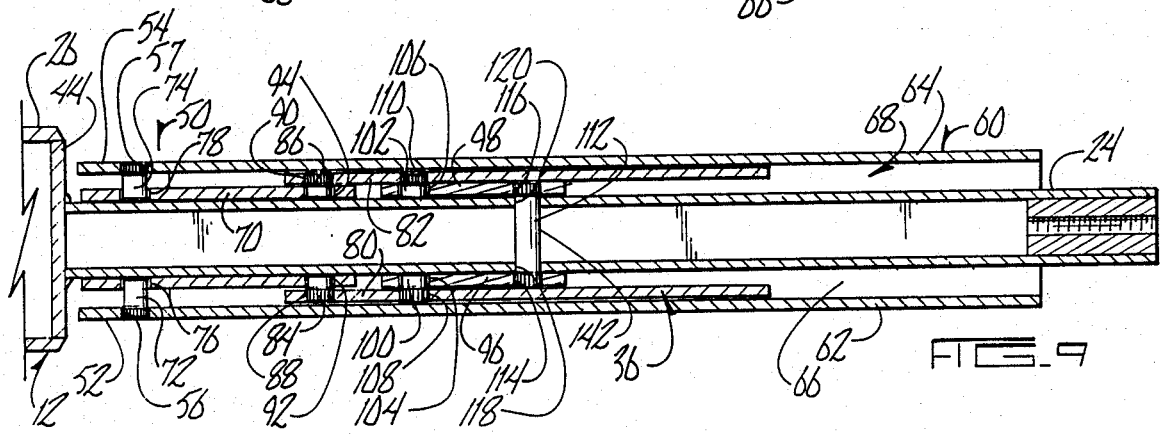
FIG. 9 is a sectional view taken along lines 9—9 of FIG. 4.

FIGS. 7, 8, and 9 depict details of the pivotal attachment between the elements of the preferred embodiment. FIG. 7 depicts pivoted connection between closure 32 and carriage 70, showing how neck 24 extends through carriage 20. FIG. 8 shows the pivotal connection of linkage arms 96 and 98, control lever 36, and neck 24. FIG. 9 shows the complete longitudinal cross-section with previously discussed pivot connections.

Figure 10:
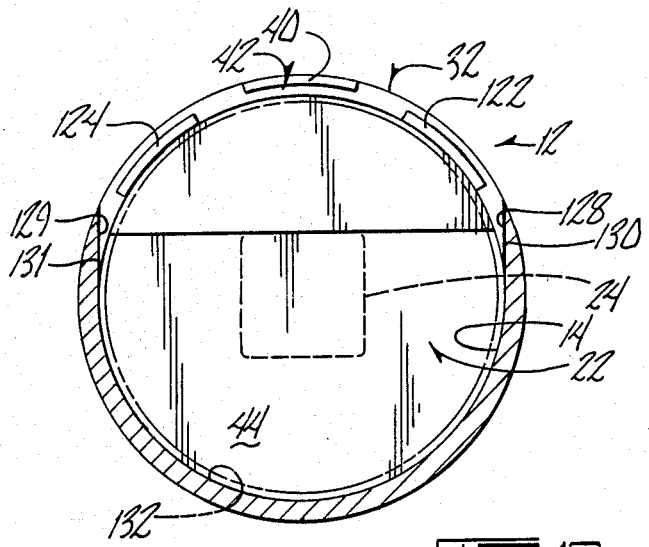
FIG. 10 is a sectional view taken along lines 10—10 of FIG. 5.

FIG. 10 shows in detail the cross-section of container 12, and tabs 40, 122, and 124 of closure 32. It can, in particular, be seen that flange rails 130 allow closure 32 to be retained along edges 128 of container 12, but easily slide therealong.

Figure 11:
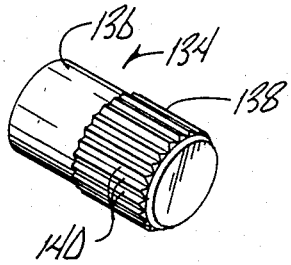
FIG. 11 is a perspective view of one type of retaining pin which can be used in the preferred embodiment of the present invention.

Finally, FIG. 11 depicts one embodiment of pivot pins which can be used in the present invention. Pivot pin 134 includes pivot end 136 and retention end 138. The retention end 138 includes raised edges 140 which allow the pin to be forcibly fit into an aperture. The raised edges 140 would cause the pin to be retained within the aperture, but would not allow pivoting or rotation. Pivot end 136, however, being of slightly less diameter than the aperture into which it is inserted, would allow pivoting around the longitudinal axis of pin 134. As can be seen in FIGS. 7–9, retention end 138 would be positioned on opposite outer sides of the piece to be pivoted. Pivot ends 136 of pivot pins 134 would then extend inwardly. The piece would then be held between the pivot pins but would be allowed to pivot.

An alternative embodiment of the pivot pin such as that shown in FIG. 11 is pivot pin 112, shown in FIGS. 3 and 9. Its opposite ends could be similar to retention in 138 of pivot pin 134 of FIG. 11, but then it could have an intermediate portion extending between retention ends which could pass through apertures and allow pivoting.

The included preferred embodiment is given by way of example, and not by way of limitation to the invention, which is solely described by the claims herein. Variations obvious to one skilled in the art will be included within the invention defined by the claims.

For example, different configurations for container 12 can be utilized. Different types of cutting edges or different cutting portions could be used at the leading edge 16 of tool 10. Additionally, the shape and configuration of opening 34 in the side of the container 12, and its corresponding cover section 48, can be designed according to choice.

It can therefore be seen that the invention accomplishes at least all of its stated objectives.

What is claimed is:

1. A soil sample extraction tool means comprising:

a container means for receiving a soil sample having outer side walls, first and second opposite ends, and a soil sample chamber accessible through an opening in the outer side walls, the first end being adapted for engaging the soil and having an aperture for allowing passage of a soil sample to the chamber;

a neck means adapted for connection of the tool means to a handle means, and being attached to and extending outwardly from the second end of the container means;

a door means for covering the opening in the outer walls of the container means;

the door means being hingeably connected to the neck means;

door opening means operatively connected to the door means for manual opening of the door means;

a carriage means which is slidable along the neck means;

the door means being hingeably connected to the carriage means on the neck means; and including locking means to lock the door means into a covering position over the opening in the container means.

2. A soil sample extraction tool comprising:

container means for receiving a soil sample, having outer walls, first and second opposite ends, and a soil sample chamber accessible through an opening in the outer walls, the first end being adapted for engaging the soil and having an aperture for allowing passage of a soil sample to the chamber;

a neck means extending outwardly from the second opposite end of the container means generally along a longitudinal axis similar to a longitudinal axis of the container means;

door means for covering the opening in the outer walls of the container means, being movable between a locked covering position over the opening in the container means, an unlocked covering position generally over the opening in the container means, and an open position allowing access to the chamber of the container means;

the opening in the container means being along the side of the container means;

the door means being both slidable and hingeable with respect to the opening of the container means;

control means for moving the door means between the locked and unlocked covering positions, the control means including a manual control handle to cause and control movement of the door means;

linkage means operatively connected between the door means and the control means; and the linkage means being hingeable with respect to the control means and the door means.

3. The tool of claim 2 wherein the walls defining the sample chamber are generally cyclindrical.

4. The tool of claim 2 further comprising a cutting means attached to the first opposite end of the container means, for cutting into the soil.

5. The tool of claim 2 wherein the container means comprises a bucket auger.

6. The tool of claim 2 wherein the door means is slidable across the opening in the container means.

7. The tool means of claim 2 wherein the control means is operatively connected to the neck means.

8. The tool of claim 7 wherein the control means comprises a lever member.

9. The tool of claim 2 wherein the door means further comprises locking tab means extending from the door means for locking the door means with respect to the container means over the opening in the container means.

10. A soil sample extraction tool comprising:

a tubular container means having a longitudinal axis, an interior chamber for receiving a soil sample accessible through an opening in the container, a first end including auger means for cutting into the soil and passing a soil sample to the chamber, and a closed second end opposite the first end;

a neck means rigidly attached to and extending outwardly from the second end of the container means generally along the longitudinal axis of the container means;

a carriage means slidable along the neck means;

a closure means for removable covering of the opening of the container means, the closure means including a hinged section hingeably connected to and pivotable on the carriage means, a cover section generally matably comforming and slidable with respect to the opening, and extending in one direction from the hinged section, and an extension section extending from the hinged section and generally in opposite direction from the cover section;

said closure means movable between a closed position where the cover section generally covers the opening and the extension section generally is adjacent the neck means, to an open position wherein the cover section is pivoted away from the opening, and the extension section is pivoted away from the neck means.

11. The tool of claim 10 wherein the closure means is movable to a third position covering the opening in the container means and locking the closure means to the container means, the closure means being movable generally co-axially to the longitudinal axis of the container in the neck to completely cover the opening.

12. The tool of claim 11 wherein a forward portion of the cover section of the closure means includes locking means for slidable engagement with the container means.

13. The tool of claim 12 wherein the locking means comprises tab means extending from the cover section of the closure means, and oriented to matably pass underneath the edge of the opening in the container means when the cover section of the closure means is slidably moved to the third position to lock and prevent the cover section from movement outwardly from the opening of the container means.

14. The tool of claim 13 wherein the tab means includes a plurality of tabs.

15. The tool of claim 14 wherein the container means includes recessed portions for matable reception of the tab means of the closure means.

16. A soil sample extraction tool means comprising:

a container means for receiving a soil sample having outer side walls, first and second opposite ends, and a soil sample chamber accessible through an opening in the outer side walls, the first end being adapted for engaging the soil and having an aperture for allowing passage of a soil sample to the chamber;

a neck means adapted for connection of the tool means to a handle means, and being attached to and extending outwardly from the second end of the container means;

a door means for covering the opening in the outer walls of the container means;

door opening means operatively connected to the door means for manual opening of the door means;

a carriage means which is slidable along the neck means;

the door means being hingeably connected to the carriage means on the neck means; and including locking means to lock it into a covering position over the opening in the container means;

the locking means comprising tabs extending from the door means, said tabs being configured so as to prevent movement of the door means outwardly from the opening when the door means is in a locked and covered position over the opening of the container means.

17. A soil sample extraction tool comprising:

container means for receiving a soil sample, having outer walls, first and second opposite ends, and a soil sample chamber accessible through an opening in the outer walls, the first end being adapted for engaging the soil and having an aperture for allowing passage of a soil sample to the chamber;

door means for covering the opening in the outer walls of the container means, being movable between a locked covering position over the opening in the container means, an unlocked covering position generally over the opening in the container means, and an open position allowing access to the chamber of the container means;

control means for moving the door means betwewen the locked and unlocked covering positions, the control means including a manual control handle to cause and control movement of the door means;

linkage means operatively connected between the door means and the control means; and locking tab means extending from the door means for locking the door means with respect to the container means over the opening in the container means.

18. The tool of claim 17 wherein the control means operates to slide the locking tab means of the door means out of a locking configuration with the container means, to allow the door means to be opened to gain access to the chamber of the container means.

* * * * *